US005580048A

United States Patent [19]

Mullen et al.

[11] Patent Number: 5,580,048

[45] Date of Patent: Dec. 3, 1996

[54] HOCKEY PUCK OR BALL RETURN APPARATUS

[75] Inventors: Kerry D. Mullen, Shorewood; Peter J. Cmiel, Minneapolis, both of Minn.

[73] Assignee: DBAPK, Inc., Edina, Minn.

[21] Appl. No.: 512,366

[22] Filed: Aug. 8, 1995

[51] Int. Cl.[6] ..... A63B 69/00

[52] U.S. Cl. ..... 273/57.2; 273/396

[58] Field of Search ..... 273/57.2, 394, 273/395, 396, 398, 400, 402

[56] References Cited

U.S. PATENT DOCUMENTS 4,883,267 11/1989 Burley ..... 273/57.2 X 5,362,045 11/1994 Hammett et al. ..... 273/57.2

*Primary Examiner*—William H. Grieb

*Attorney, Agent, or Firm*—Palmatier, Sjoquist & Helget, P.A.

[57] ABSTRACT

A modular return apparatus for reflecting back an object such as a puck or ball when struck by the puck or ball traveling on a playing surface, for use in returning the puck or ball to the player for another shot and in training the player to shoot the puck or ball accurately and anticipate the angle of reflection and velocity of the puck or ball comprises an elongated reflecting bumper, a pair of supports for the reflecting bumper, and a rod for connecting the supports to each other and preventing their relative motion. A net may be attached to the return apparatus to catch the puck.

17 Claims, 4 Drawing Sheets

HOCKEY PUCK OR BALL RETURN APPARATUS

BACKGROUND OF THE INVENTION

This invention relates to a hockey return apparatus for reflecting back an object such as a puck or ball when struck by the puck or ball traveling on a playing surface, for use in training the player to shoot the puck or ball accurately and anticipate the angle of reflection and velocity of the puck or ball and for returning the puck or ball to the player to be shot again.

In the game of hockey, whether played with a puck or with a ball, constant practice is necessary to achieve competent play. A player must learn to impart sufficient velocity to the puck or ball to either send it into the net or to bounce it off the side walls of the hockey arena at the correct angle and force to cause the puck or ball to reflect off the arena walls toward another player or another area of the arena. The player must also learn to shoot the puck into the net.

The invention has a similar purpose to a pitch-back in baseball or a "backboard" in tennis. A return apparatus is necessary to practice shooting the puck or ball because sufficient "ice time" is rarely available for practice. Many parents of children find their garage doors dented and scarred by hockey pucks because of the lack of a substitute return apparatus. With the rising popularity of in-line skating, street hockey is increasing in popularity, further requiring a puck or ball return apparatus for practice.

There is a need for a hockey return apparatus which returns the puck or ball to the player to be shot again. Because street or driveway playing surfaces have a much higher coefficient of sliding friction than ice, the return apparatus should impart sufficient return velocity to the puck or ball to overcome this increased sliding friction and return the puck or ball to the player. Furthermore, when struck by a puck or ball, the return apparatus should reflect the puck or ball in approximately the same way that the arena sidewalls do.

SUMMARY OF THE INVENTION

A modular return apparatus for reflecting back an object such as a puck or ball when struck by the puck or ball traveling on a playing surface, for use in returning the puck or ball to the player for another shot and in training the player to shoot the puck or ball accurately and anticipate the angle of reflection and velocity of the puck or ball comprises an elongated reflecting bumper, a pair of supports for the reflecting bumper, and a rod for connecting the supports to each other and preventing their relative motion. A net may be attached to the return apparatus to catch the puck.

A principal object and advantage of the present invention is that it returns the puck or ball to the player for another shot.

Another object and advantage of the present invention is that it reflects an incoming puck or ball in approximately the same way that the puck or ball would be reflected by the arena sidewalls, thus allowing the player to practice his shots outside the arena.

Another object and advantage of the present invention is that it reduces damage to garage doors or other surfaces by providing a much better return apparatus than the garage door.

Another object and advantage of the present invention is that it may overcome the high coefficient of sliding friction of street or driveway playing surfaces.

A feature of the present invention is that the reflecting bumper may be substantially rigid so that the puck or ball reflects off the bumper in approximately the same manner as it reflects off the arena walls.

Another feature of the present invention is that it may be resilient, in order to impart increased return velocity to the puck or ball to overcome the high coefficient of sliding friction of street or driveway playing surfaces.

Another feature of the present invention is that it is modular and may be connected to others of the invention in order to build a complete practice arena.

Another feature of the present invention is that it may include a net for receiving a ball or puck.

Another feature of the present invention is that it may be taken apart into components for storage.

DETAILED DESCRIPTION OF THE PREFERRED EMBODIMENTS

Figure 1:
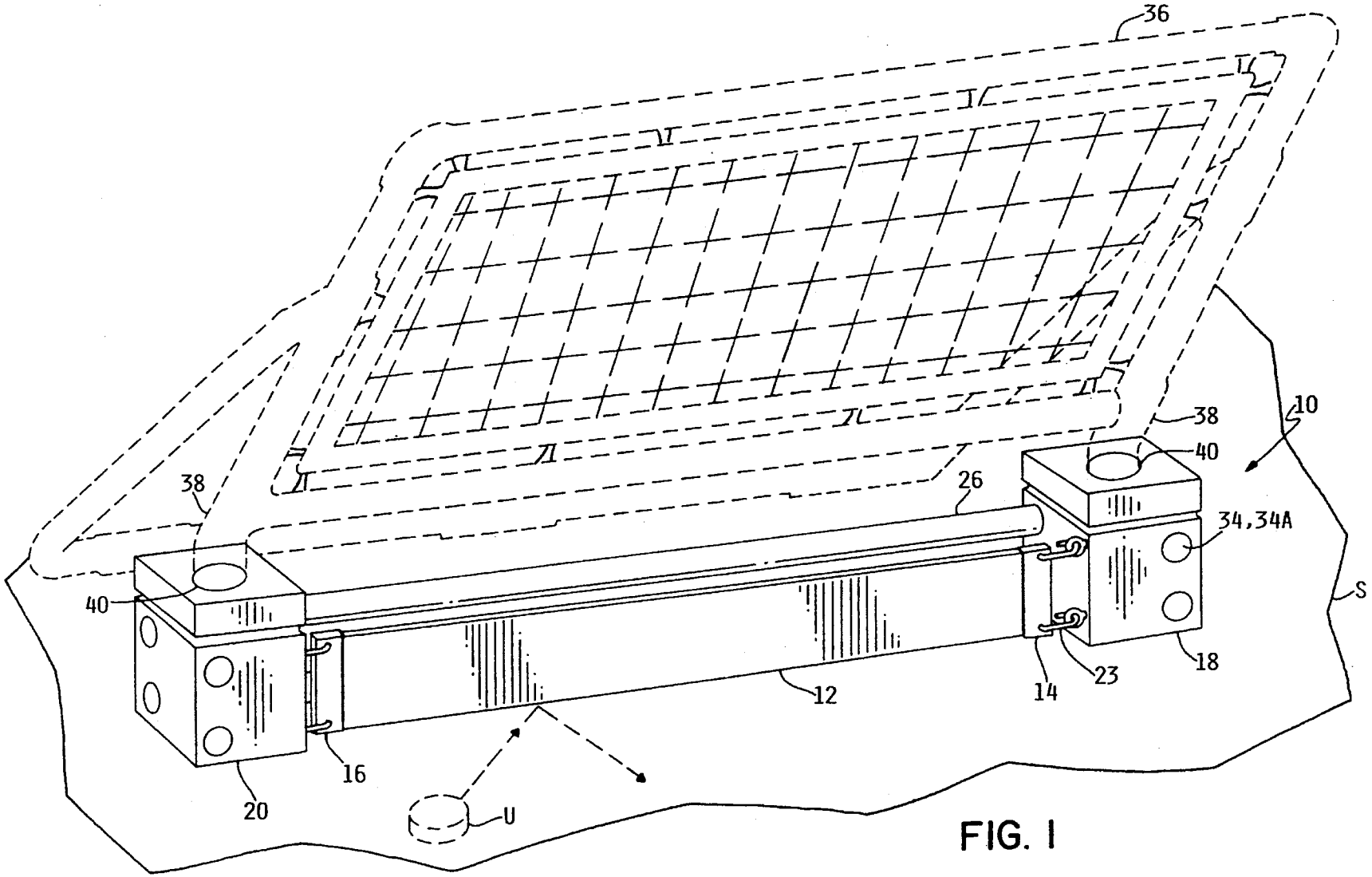
FIG. 1 is a perspective view of the apparatus of the present invention with an optional net shown in phantom.

The modular return apparatus of the present invention is shown generally in the Figures as reference numeral 10.

The return apparatus 10 comprises an elongated reflecting bumper 12 having a first end 14 and a second end 16. A first support 18 is connected to the first end 14 and a second support 20 is connected to the second end 16. Both the first support 18 and the second support 20 rest on the playing surface S.

It will be seen that when the player P (FIG. 2) shoots an object such as the puck U against the reflecting bumper 12, the reflecting bumper 12 will reflect back the puck U, as shown in FIG. 1. The puck U will thus be returned toward the player P so that the player P can shoot the puck again. The player P may thus make many practice shots against the return apparatus 10 without the need for another player and may do so in a driveway or other playing surface outside an arena. This maximizes the amount of practice which the player P may gain during a given amount of time.

The return apparatus 10 will absorb the force of the impact of the puck P, rather than having a garage or other surface do so. This will prevent damage and scarring to the garage door or other surface.

It will be apparent that the force of the puck U striking the reflecting bumper 12 may cause either the first support 18 or the second support 20 to move. To prevent this motion, both the first support 18 and the second support 20 may be weighted. The first support 18 and second support 20 may be hollow and may be filled with ballast such as water, sand, or other weighting material. Such weighting adds stability to the first support 18 and second support 20 and increases the coefficient of friction between the first support 18 and second support 20 and the playing surface S. Additionally, the first support 18 and second support 20 may have a non-slip surface (not shown) in contact with the playing surface in order to increase the coefficient of friction between the first support 18 and second support 20 and the playing surface S.

The reflecting bumper 12 may be substantially rigid. In this embodiment (FIG. 3), the reflecting bumper 12 approximates the way that the sidewall of an arena may reflect the puck U.

Figure 3:
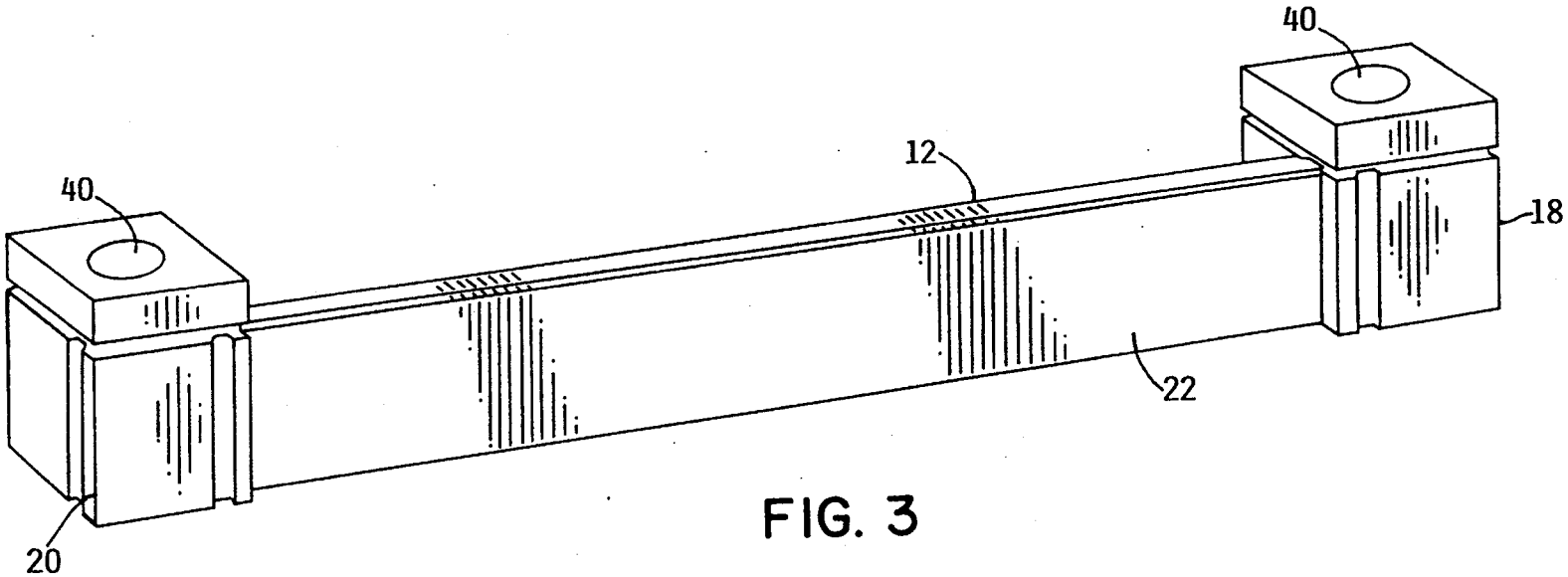
FIG. 3 is a perspective view of a second embodiment of the present invention, wherein the reflecting bumper is substantially rigid.

In another embodiment, the reflecting bumper 12 may be rigid with a layer of resilient material 22 upon which the puck U strikes (FIG. 3). The layer of resilient material 22 will impart additional return velocity to the puck U, helping to overcome the coefficient of sliding friction between the puck U and the playing surface S.

Figure 4:
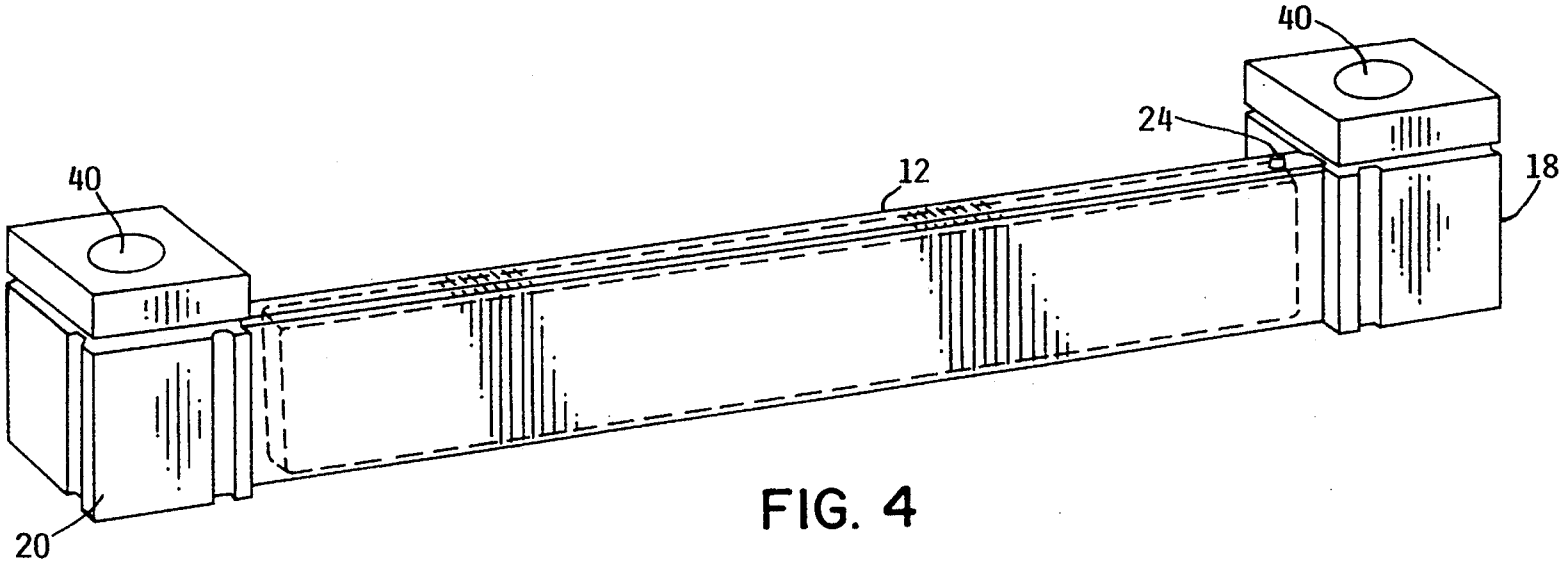
FIG. 4 is a perspective view of a third embodiment of the present invention, wherein the reflecting bumper is inflated with air.

In another embodiment, the reflecting bumper 12 may be resilient (FIGS. 1 and 4). Because playing surfaces such as driveways and streets have a much greater coefficient of sliding friction than ice, a resilient reflecting bumper 12 may return the puck U to the player P more readily than if the reflecting bumper 12 is rigid.

The reflecting bumper 12 may be constructed of elastomeric materials such as rubber, styrene, or polyvinyl chloride (PVC). The reflecting bumper 12 may be connected to the first support 18 and the second support 20 by elastic connectors 23, such as springs, cords, straps, or bungee cords. This will increase the resiliency of the bumper 12.

The reflecting bumper 12 may alternatively be hollow and filled with compressed air (FIG. 4) by means of an air valve 24. The reflecting bumper 12 will be resilient by virtue of being filled with compressed air.

The return apparatus 10 may also include a rod 26 connecting the first support 18 to the second support 20 in order to prevent the relative motion of the first support 18 and second support 20. Thus, the first support 18 and second support 20 will not move relative to each other when the reflecting bumper 12 is struck by the puck U.

Figure 5:
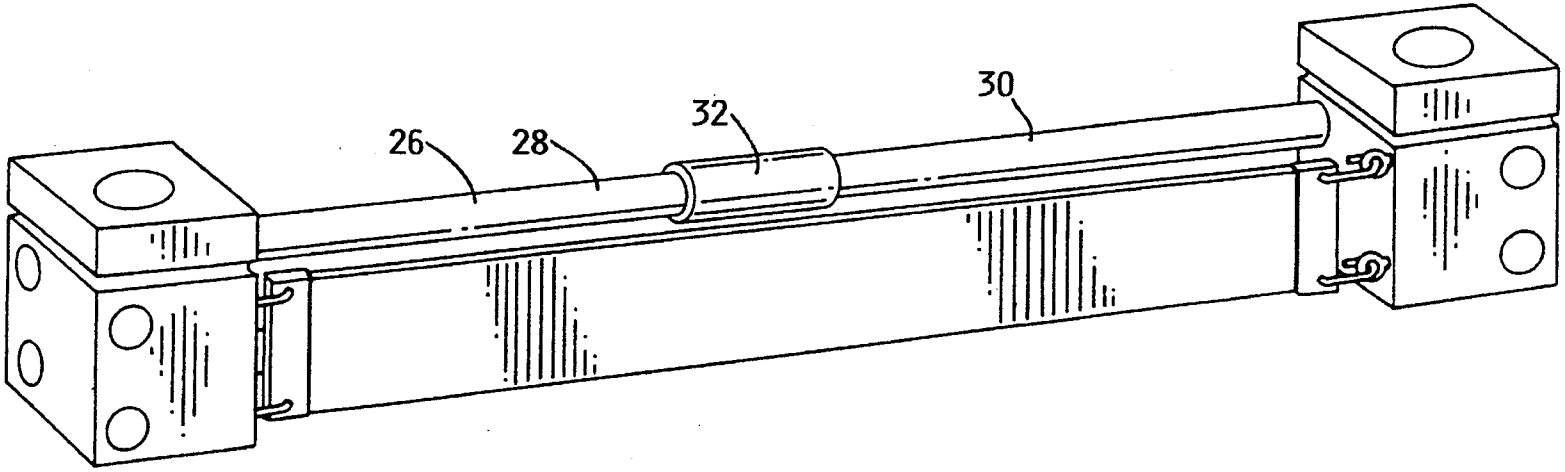
FIG. 5 is a perspective view of another embodiment of the present invention, in which the rod joining the supports comprises two segments connected together by a sleeve.
Figure 6:
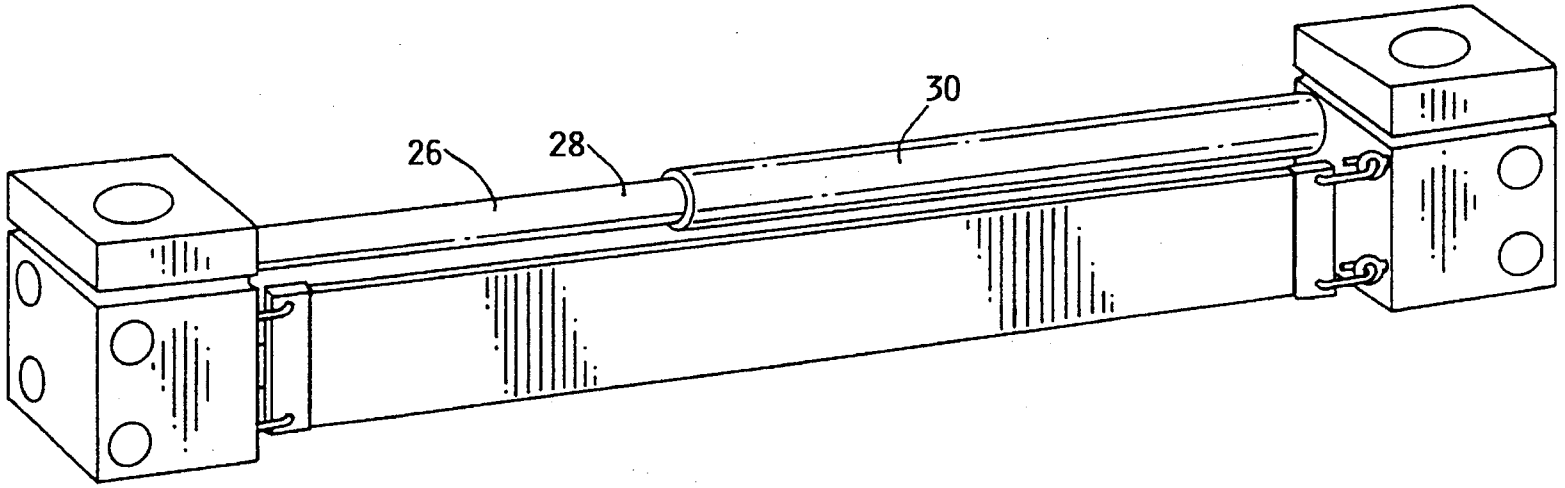
FIG. 6 is a perspective view of another embodiment of the present invention, in which the rod joining the supports comprises two segments connected together by telescoping with one another.

In order to allow the return apparatus 10 to be taken apart into components for storage and transportation, the rod 26 may comprise two segments 28, 30 which may be joined together to form the rod 26. The rod segments 28, 30 may be joined together by a sleeve 32, as shown in FIG. 5. Alternatively, the rod segments 28, 30 may be telescoping, as shown in FIG. 6.

Figure 2:
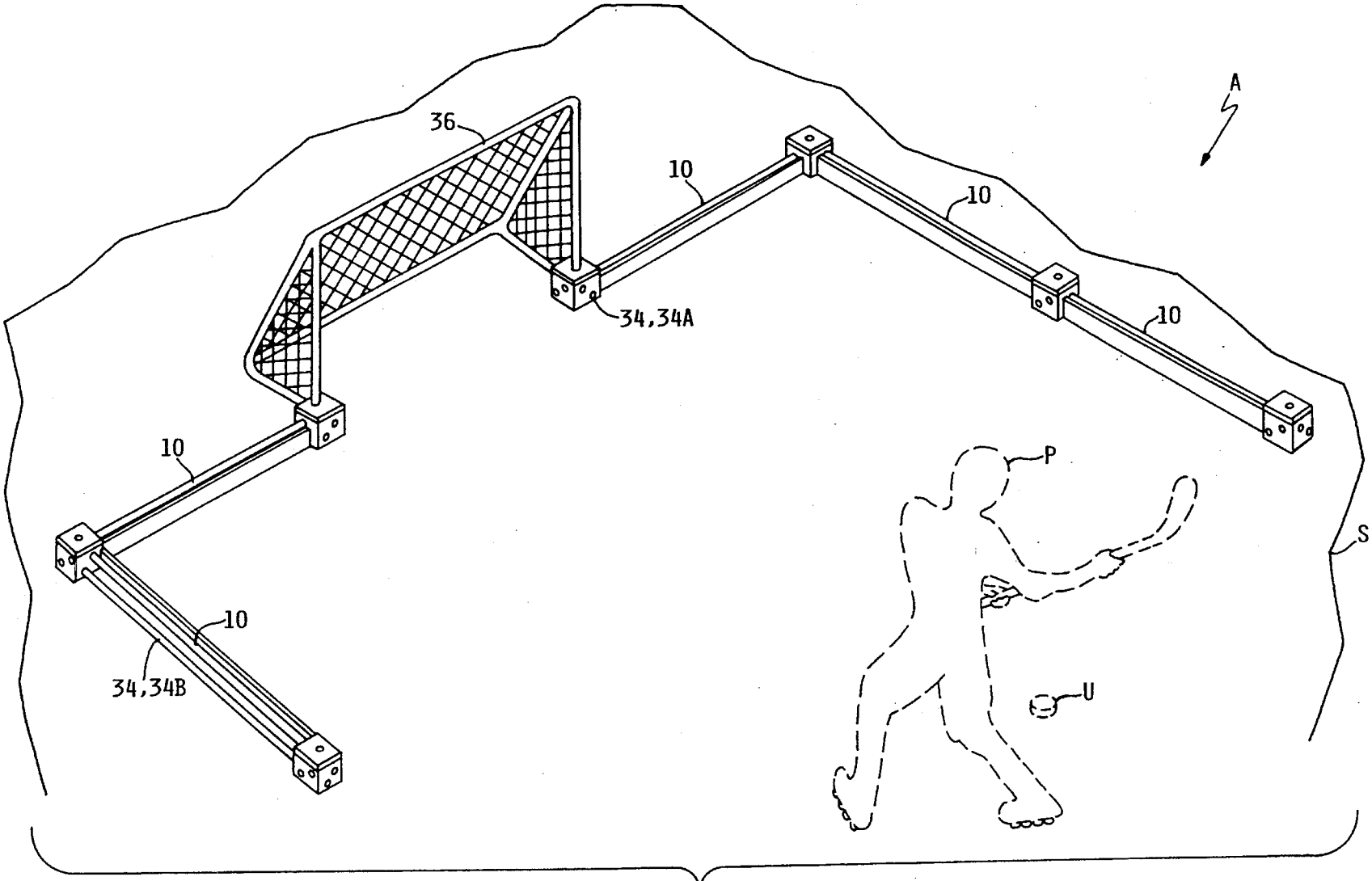
FIG. 2 is a perspective view of several of the apparatuses of the present invention connected together to form an arena with a net. A player is shown in phantom.

The return apparatus 10 may have means 34 for connecting the return apparatus 10 to others of the return apparatus 10 to form an arena A, as shown in FIG. 2. The means 34 may be apertures 34A in the first support 18 or second support 20 which may connect by rods 34B to corresponding apertures 34A in others of the return apparatus 10. Other means of connection such as clamps, screws, or bolts may also be used to connect the rods 34B to the supports.

The return apparatus 10 may further include a net 36 for catching the puck U as an airborne shot, i.e., when the puck is sent through the air above the playing surface P. The net 36 may be connected to the first support 18 and second support 20 by posts 38 which mate with corresponding holes 40 in the first support 18 and second support 20.

Although the object that is reflected back by the return apparatus 15 has been described as a puck U, it will be apparent that other objects such as a ball may also be returned.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. In the sport of hockey, a modular return apparatus for reflecting back an object when struck by the object traveling on a playing surface, for returning the object to the player for another shot and for training the player to shoot the object accurately and anticipate the angle of reflection and velocity of the object and for catching the object, comprising:

an elongated reflecting bumper having a first end and a second end, a first support connected to said first end, said first support resting on the playing surface, and a second support connected to said second end, said second support resting on the playing surface, whereby said reflecting bumper reflects back an object when struck by the object, wherein said first support and said second support are weighted by being hollow and filled with ballast to impart stability to said first support and said second support and to increase the friction coefficient between the playing surface and said first support and said second support.

2. The modular return apparatus of claim 1, wherein said first support and said second support each has a nonslip surface in contact with the playing surface.

3. The modular return apparatus of claim 1, wherein said reflecting bumper is substantially rigid.

4. The modular return apparatus of claim 3, wherein said reflecting bumper further comprises a layer of resilient material.

5. The modular return apparatus of claim 1, wherein said reflecting bumper is resilient.

6. The modular return apparatus of claim 5, wherein said reflecting bumper is constructed of an elastomeric material.

7. The modular return apparatus of claim 5, wherein said reflecting bumper further comprises a core filled with compressed air.

8. The modular return apparatus of claim 5, wherein said reflecting bumper is attached to said first support and to said second support by elastic connectors.

9. The modular return apparatus of claim 1, further comprising a rod connecting said first support to said second support and preventing the relative motion of said first support and said second support.

10. The modular return apparatus of claim 9, wherein said rod further comprises two segments.

11. The modular return apparatus of claim 10, wherein said segments are connected by a sleeve.

12. The modular return apparatus of claim 10, wherein said segments are telescoping.

13. The modular return apparatus of claim 1, further comprising means for connecting said return apparatus to other of said return apparatus.

14. The modular return apparatus of claim 1, further comprising a net for catching the object.

15. A modular return apparatus for reflecting back an object when struck by the object traveling on a playing surface, for returning the object to the player for another shot and for training the player to shoot the object accurately and anticipate the angle of reflection and velocity of the object and for catching the object, comprising:

an elongated reflecting bumper having a first end and a second end, a first support connected to said first end, said first support resting on the playing surface, a second support connected to said second end, said second support resting on the playing surface, and a rod connecting said first support to said second support and preventing the relative motion of said first support and said second support, whereby said reflecting bumper reflects back an object when struck by the object.

16. The modular return apparatus of claim 15, wherein said first support and said second support are weighted to impart stability to said first support and said second support and to increase the friction coefficient between the playing surface and said first support and said second support.

17. A modular return apparatus for reflecting back an object when struck by the object traveling on a playing surface, for returning the object to the player for another shot and for training the player to shoot the object accurately and anticipate the angle of reflection and velocity of the object and for catching the object, comprising:

an elongated reflecting bumper having a first end and a second end, a first support connected to said first end, said first support resting on the playing surface, a second support connected to said second end, said second support resting on the playing surface, and a rod connecting said first support to said second support and preventing the relative motion of said first support and said second support, wherein said first support and said second support are weighted, whereby said reflecting bumper reflects back an object when struck by the object.

* * * * *